US006361296B1

(12) United States Patent
Hirooka et al.

(10) Patent No.: US 6,361,296 B1
(45) Date of Patent: Mar. 26, 2002

(54) SCROLL TYPE COMPRESSOR HAVING A GAP THAT COLLECTS AND SUPPLIES OIL TO AN OIL SUPPLY PATH OR THE ECCENTRIC BEARING

(75) Inventors: Katsumi Hirooka; Hiroyuki Kobayashi; Susumu Matsuda, all of Aichi-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/464,819

(22) Filed: Dec. 17, 1999

Related U.S. Application Data

(62) Division of application No. 08/866,495, filed on May 30, 1997, now Pat. No. 6,012,911.

(30) Foreign Application Priority Data

Sep. 6, 1996 (JP) ..... 8-236737

(51) Int. Cl.[7] ..... F04C 18/04; F04C 29/02

(52) U.S. Cl. ..... 418/55.5; 418/55.6; 418/88; 418/94

(58) Field of Search ..... 418/55.5, 55.6, 418/88, 94

(56) References Cited

U.S. PATENT DOCUMENTS

| | | | | |
|---|---|---|---|---|
| 4,997,349 A | | 3/1991 | Richardson, Jr. | 418/55.6 |
| 5,197,868 A | | 3/1993 | Caillat et al. | 418/55.6 |
| 5,395,224 A | * | 3/1995 | Caillat et al. | 418/55.6 |

FOREIGN PATENT DOCUMENTS

| | | | | |
|---|---|---|---|---|
| EP | 0469700 | | 2/1992 | |
| JP | 58065986 | | 4/1983 | |
| JP | 60178988 | | 9/1985 | |
| JP | 3-175185 | * | 7/1991 | 418/55.6 |
| JP | 3175188 | | 7/1991 | |
| JP | 03175188 A | | 7/1991 | |
| JP | 04012186 A | | 1/1992 | |
| JP | 07063174 A | | 3/1995 | |
| JP | 08035495 A | | 2/1996 | |

* cited by examiner

*Primary Examiner*—John J. Vrablik
(74) *Attorney, Agent, or Firm*—Alston & Bird LLP

(57) ABSTRACT

The present invention provides a scroll-type compressor that can supply sufficient lubricating oil without the occurrence of seizure of bearing for an orbiting scroll. In this scroll-type compressor, an annular boss 23 extends downward from the orbiting scroll, and an eccentric pin 53 of a rotating shaft 5 fits into the boss 23 via a bearing 73 and an eccentric bush 54. A gap 58 is provided between the eccentric pin 53 and the eccentric bush 54, and an oil supply path 57 is provided between the eccentric bush 54 and the bearing 73. The lubricating oil flows out of an oil supply hole 52 formed in a rotating shaft 5 and the eccentric pin 53, being supplied to the bearing 73, etc. via the oil supply path 57. In order to sufficiently supply the lubricating oil to the oil supply path 57, a portion 54*f* extending in an arcuate shape from the upper end face of the eccentric bush 54 forms a protrusion extending upward from the other flat portion 54*d*. The protrusion 54*f* may be formed in an annular shape along the inner peripheral surface of the eccentric bush 54, or a flat plate member 59 may be provided to close the gap 58 from the downside without providing the protrusion 54*f*.

15 Claims, 6 Drawing Sheets

SCROLL TYPE COMPRESSOR HAVING A GAP THAT COLLECTS AND SUPPLIES OIL TO AN OIL SUPPLY PATH OR THE ECCENTRIC BEARING

CROSS-REFERENCES TO RELATED APPLICATIONS

This application is a division of U.S. patent application Ser. No. 08/866,495, filed on May 30, 1997, U.S. Pat. No. 6,012,911, which is hereby incorporated herein in its entirety by reference.

FIELD OF THE INVENTION AND RELATED ART STATEMENT

The present invention relates to a scroll-type compressor having a mechanism for preventing seizure of bearing for an orbiting scroll.

Various scroll-type compressors relating to the present invention have been proposed, and one example thereof is shown in FIG. 8. In this figure, in a closed housing 8, a scroll-type compressing mechanism C is housed at the upper part thereof and an electric motor M at the lower part thereof. The compressing mechanism C is connected to the electric motor M via a rotating shaft 5 so as to be driven by the electric motor M. The scroll-type compressing mechanism C includes a fixed scroll 1, an orbiting scroll 2, a rotation checking mechanism 3 such as an Oldham's ring, which permits orbital motion of the orbiting scroll 2 but checks rotation thereof, a frame 6 to which the fixed scroll 1 is fastened, and an upper bearing 71, which pivotally supports the rotating shaft 5.

The fixed scroll 1 has an end plate 11 and a spiral wrap 12 extending downward from the lower surface of the end plate 11. The end plate 11 is provided with a discharge port 13, which is formed by penetrating the end plate 11, and a discharge valve 17 for opening/closing the discharge port 13. The orbiting scroll 2 has an end plate 21 and a spiral wrap 22 extending upward from the upper surface of the end plate 21. The two spiral wraps 12 and 22 are lapped in the radial direction. In a cylindrical boss 23 provided so as to extend downward from the lower surface of the end plate 21, an eccentric bush 54 is rotatably inserted via an orbiting bearing 73. Into a hole 55 defined by the eccentric bush 54, an eccentric pin 53 protruding from the top end of the rotating shaft 5 is rotatably fitted. By engaging the spiral wraps 12 and 22 with each other so that the fixed scroll 1 and the orbiting scroll 2 are made off-centered by a predetermined distance and the angle thereof is shifted 180 degrees, a plurality of closed spaces 24 are formed. The spiral wraps 12 and 22 which form such closed spaces 24 are shown in FIG. 7 of Japanese Patent Provisional Publication No. 7-63174 (No. 63174/1995), for example.

The frame 6 is fixed in the closed housing 8, and the thrust surface 65 formed on the upper surface of the frame 6 is in slidable contact with the lower surface of the orbiting scroll 2 so that the orbiting scroll 2 is supported by the frame 6. The thrust surface 65 is formed with an annular oil groove 66. A hole circular in transverse cross section formed at the center of the upper surface of the frame 6 is closed by the lower surface of the orbiting scroll 2, thereby defining an oil reservoir 61. At the lower part of the inner wall surface of the frame 6, which defines the oil reservoir 61, is formed a oil discharge hole 62 so as to be inclined downward toward the outside in the radial direction.

A positive-displacement oil pump 51 is installed at the lower end of the rotating shaft 5. A suction pipe 56 is connected to a suction port (not shown) of the oil pump 51, and the tip end thereof is open in an oil sump 81 at the bottom of the closed housing 8. A discharge port (not shown) of the oil pump 51 is connected to an oil supply hole 52 formed in the rotating shaft 5 in the axial direction.

By driving the electric motor M, the orbiting scroll 2 is driven via an orbital motion mechanism consisting of the rotating shaft 5, eccentric pin 53, eccentric bush 54, boss 23, etc. The orbiting scroll 2 performs orbital motion in the circular orbit with the orbiting radius while the rotation is checked by the rotation checking mechanism 3.

By this motion, suction gas enters the closed housing 8 through a suction pipe 82, being introduced into a suction passage 15 through a gas passage 85, and sucked into the aforesaid closed spaces 24. The suction gas reaches the central portion of the spiral wraps 12, 22 while being compressed as the volume of the closed space 24 is decreased by the orbital motion of the orbiting scroll 2, goes out through the discharge port 13, and enters the discharge cavity 14 by pushing and opening the discharge valve 17, being discharged from the discharge cavity 14 through a discharge pipe 83.

On the other hand, since the oil pump 51 is also driven at the same time the electric motor M is driven, lubricating oil stored in the oil sump 81 at the bottom of the closed housing 8 is sucked via the suction pipe 56, being sent to the oil supply hole 52. The lubricating oil flows upward in the oil supply hole 52. Some of the lubricating oil branches halfway from the main flow to lubricate a lower bearing 72 and the upper bearing 71, and the main flow spouts from an opening of the oil supply hole 52 formed at the tip end of the eccentric pin 53 to lubricate the eccentric pin 53 and the orbiting bearing 73, and enters the oil reservoir 61. Subsequently, the lubricating oil passes through the oil groove 66 to lubricate sliding parts such as the thrust surface 65 and the rotation checking mechanism 3. Also, some of the lubricating oil entering the oil reservoir 61 drops through the oil discharge hole 62, passes through a passage 9 formed between the outer periphery of the stator of the electric motor M and the closed housing 8, and then is stored in the oil sump 81.

FIG. 9 is a view for illustrating the relationship between the eccentric bush 54 and the eccentric pin 53 in the above-described scroll-type compressor, being viewed from the upside, and FIG. 10 is a sectional view for illustrating the relationship, viewed from the side. A flat portion of the eccentric bush 54 shown in the figure abuts on a flat portion at the outer periphery of the eccentric pin 53, so that the eccentric bush 54 rotates integrally with the eccentric pin 53. The lubricating oil discharged from the oil supply hole 52 is supplied to an oil supply path 57 defined between the flat portion formed at the outer periphery of the eccentric bush 54 as shown in the figure and the orbiting bearing 73. Some of the lubricating oil is also supplied to a gap 58 formed between the outer periphery of the eccentric pin 53 necessary for the orbiting scroll 2 to perform orbital motion and the inner periphery of the eccentric bush 54, and is introduced from the gap 58 to the oil reservoir 61.

In the above-described scroll-type compressor, the lubricating oil discharged from the oil supply hole 52 in the eccentric pin 53 is distributed to the oil supply path 57 and the gap 58. The lubricating oil going out from the oil supply hole 52 on the top end face of the eccentric pin 53 enters a concave 53*a* defined between the upper outer peripheral surface of the eccentric pin 53 and the inner peripheral edge of the eccentric bush 54. From the concave 53*a*, some of the lubricating oil flows toward the oil supply path 57, and some thereof enters the gap 58. The oil distributed to the oil supply path 57 is supplied to the orbiting bearing 73 having a high sliding speed, and the oil distributed to the gap 58 is supplied to the flat portion of the eccentric pin having a low sliding speed; however, most of the lubricating oil drops into the oil reservoir 61. Therefore, for the orbiting bearing 73 having a high sliding speed, the amount of oil in the oil supply path 57 is smaller than the necessary amount, so that there is a possibility for seizure of the bearing 73 to occur.

OBJECT AND SUMMARY OF THE INVENTION

The present invention was made in view of the above situation, and accordingly an object thereof is to provide a scroll-type compressor which solves the above problem and can supply sufficient lubricating oil without the occurrence of seizure of bearing.

To achieve the above object, the present invention provides a scroll-type compressor comprising a closed housing having a gas inlet and outlet; a support frame fixed in the closed housing; a scroll-type compressing mechanism which has a fixed scroll and a orbiting scroll disposed above the support frame and engaging with each other, fastens the fixed scroll to the support frame, and supports the orbiting scroll by bringing the orbiting scroll into slidable contact with the support frame; a rotating shaft which is disposed below the scroll-type compressing mechanism, extends upward by penetrating the support frame, and is fitted in a boss of the orbiting scroll at an eccentric pin portion at the upper end via an eccentric bush and a bearing; an electric motor for driving the orbiting scroll via the rotating shaft; and an oil pump provided at the lower end of the rotating shaft, wherein a gap is formed between the outer peripheral surface of the eccentric pin portion and the inner peripheral surface of the eccentric bush to permit the orbiting motion of the orbiting scroll, the oil supply path extending in the axial direction is provided between the outer peripheral surface of the eccentric bush and the inner peripheral surface of the bearing, and the rotating shaft and the eccentric pin portion are formed with an oil supply hole, which communicates with the oil pump and is open at the upper end face of the eccentric pin portion, so that lubricating oil is allowed to pass through the oil supply hole by the drive of the oil pump and supplied to the bearing, and the lubricating oil flowing out of the oil supply hole is supplied to the bearing via the oil supply path and supplied to a space between the support frame and the orbiting scroll.

According to a first embodiment of the present invention, a part of the upper end face of the eccentric bush is formed with a protrusion extending upward in the axial direction from other flat portion of the upper end face of the eccentric bush on the upstream side with respect to the direction of rotation of the rotating shaft, with the peripheral end of an outer peripheral oil supply path on the upstream side with respect to the direction of rotation of the rotating shaft being almost the base point. If a protrusion is formed limitedly in such a manner, the lubricating oil flowing out of the oil supply hole at the upper end face of the eccentric bush easily flows on the flat portion of the upper end face in the outer peripheral direction under the action of centrifugal force, so that the amount of lubricating oil to the oil supply path increases, which contributes to the prevention of seizure of bearing. In accordance with one aspect of the invention, it is preferable that the protrusion be formed substantially over a half of circumference of the upper end face of the eccentric pin portion.

Also, according to a second embodiment of the present invention, in the above-described scroll-type compressor, the upper end face of the eccentric bush is formed with an inner peripheral portion along the upper edge of the inner peripheral surface of the eccentric bush substantially over the whole circumference as a protrusion extending upward in the axial direction from the flat outer peripheral portion along the upper edge of the outer peripheral surface of the eccentric bush. If the protrusion is formed in such a manner, the lubricating oil flowing out of the oil supply hole at the upper end face of the eccentric bush goes beyond the protrusion under the action of centrifugal force, enters a concave formed consequently between the protrusion and the bearing, and is directed surely from here to the oil supply path, which contributes to the prevention of seizure of bearing.

Further, according to a third embodiment of the present invention, an annular flat plate member is provided between the lower end face of the eccentric bush and the upper end face of the rotating shaft so as to cover the gap from the downside. Since the bottom of the gap is substantially closed by this flat plate member, the amount of lubricating oil entering this gap is at a constant minimum, so that the supply amount to the oil supply path increases further.

The effects of the present invention are as described below.

As described above, according to the first embodiment of the present invention, the flow of lubricating oil into the gap between the outer periphery of the eccentric pin and the inner periphery of the eccentric bush, which is necessary for the orbiting scroll to perform the orbital motion, is limited. Therefore, the amount of lubricating oil supplied to the oil supply path for the orbiting bearing increases significantly, so that the seizure of the orbiting bearing and eccentric bush can be prevented effectively.

In particular, where, the protrusion is formed substantially over a half of circumference of the upper end face of the eccentric bush, the lubricating oil striking the protrusion can be guided effectively to the oil supply path, so that the oil supply amount is further increased, which contributes to the prevention of seizure.

Also, if, as in the second embodiment of the present invention, the upper end face of the eccentric bush is formed with an inner peripheral portion along the upper edge of the inner peripheral surface of the eccentric bush substantially over the whole circumference as a protrusion extending upward in the axial direction from the flat outer peripheral portion along the upper edge of the outer peripheral surface of the eccentric bush, the oil supply amount to the oil supply path is further increased, so that the prevention of seizure can further be achieved.

Further, if, as in the third embodiment of the present invention, an annular flat plate member is provided between the lower end face of the eccentric bush and the upper end face of the rotating shaft so as to cover the gap between the outer peripheral surface of the eccentric pin portion and the inner peripheral surface of the eccentric bush from the downside, the lubricating oil does not substantially drop into an oil reservoir even if the lubricating oil flows into the gap. Therefore, the amount of lubricating oil entering the gap is at a minimum, so that the supply amount to the oil supply path is further increased, by which the seizure can be prevented more preferably.

DETAILED DESCRIPTION OF PREFERRED EMBODIMENTS

Figure 8:
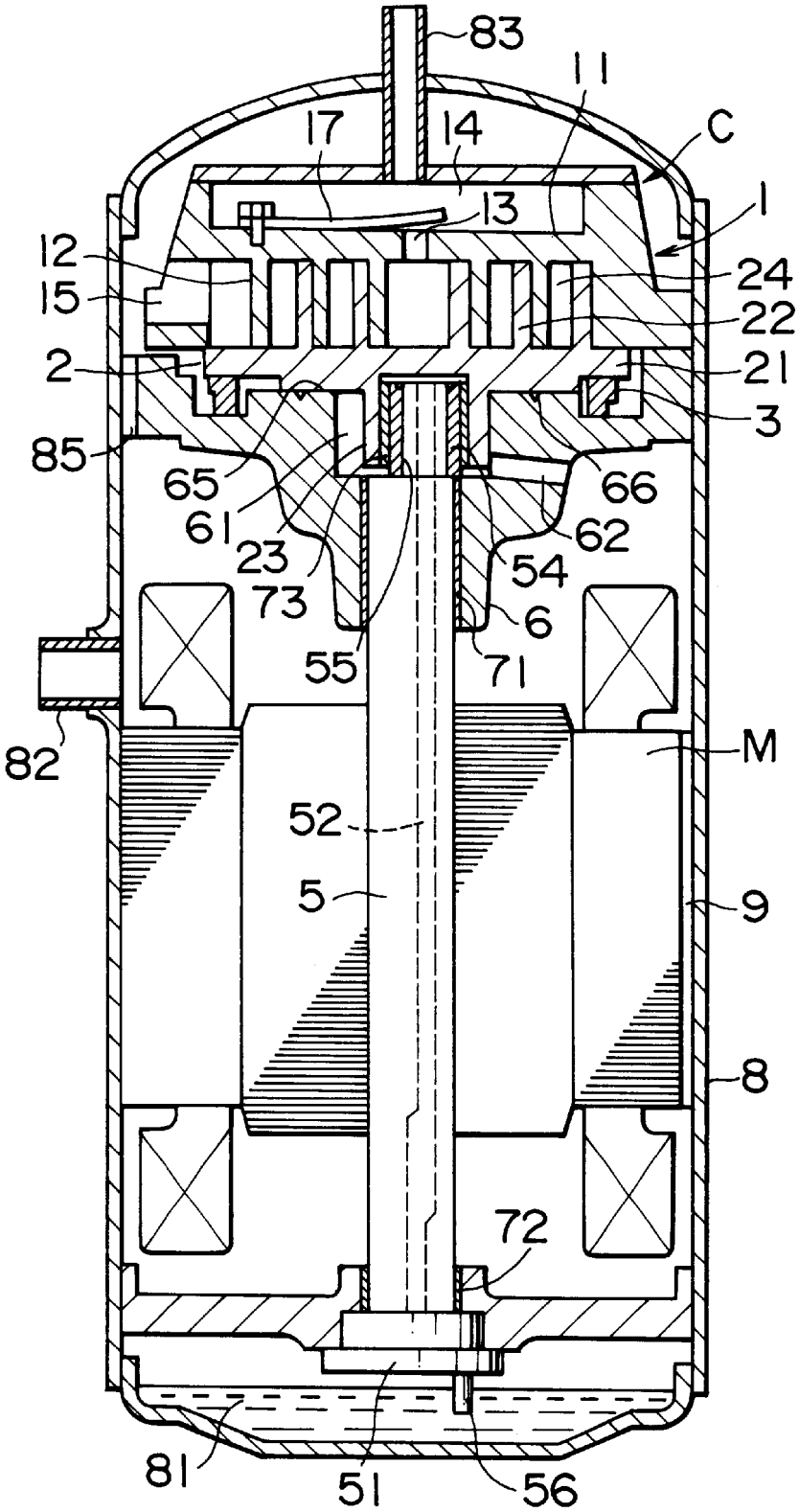
FIG. 8 RELATED ART
FIG. 8 is a longitudinal sectional view showing an overall configuration of a scroll-type compressor relating to the present invention.
Figure 9:
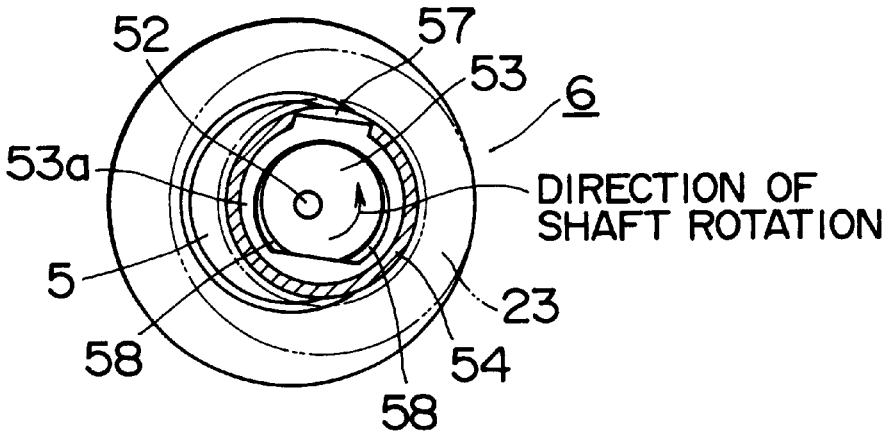
FIG. 9 RELATED ART
FIG. 9 is a plan view, partly in cross section, of an eccentric bush, eccentric pin, etc. relating to the scroll-type compressor shown in FIG. 8, being viewed from the upside.
Figure 10:
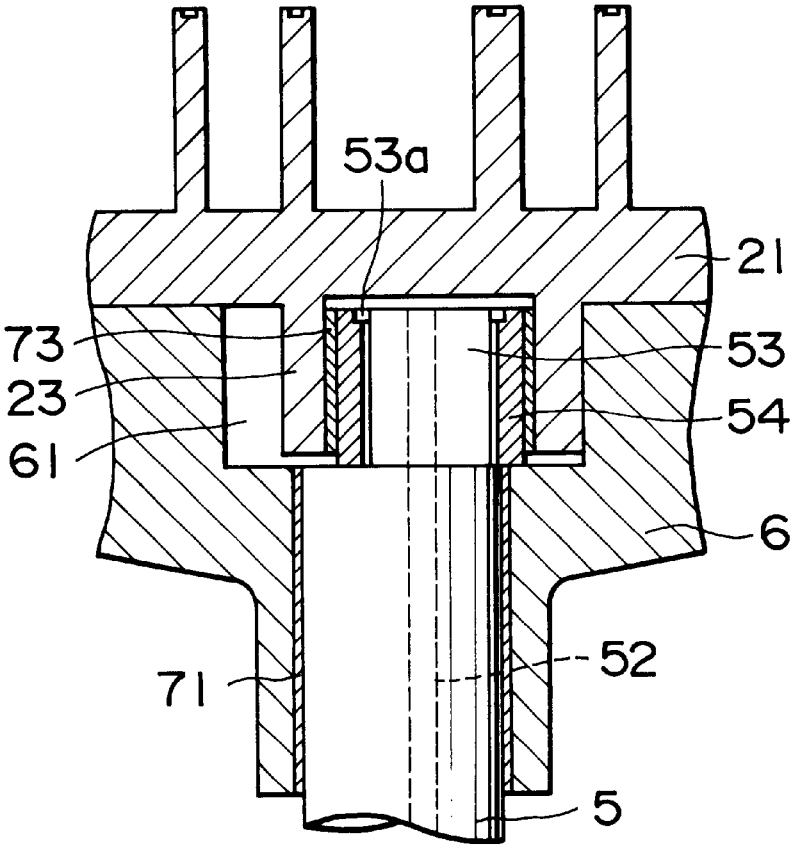
FIG. 10 RELATED ART
FIG. 10 is a side sectional view corresponding to FIG. 3 showing the scroll-type compressor shown in FIG. 8.

Preferred embodiments of the present invention will be described below with reference to the accompanying drawings. In the drawings, including FIGS. 8 to 10 showing the related art, the same reference numerals indicate the same or corresponding elements.

[First Embodiment]

Figure 1:
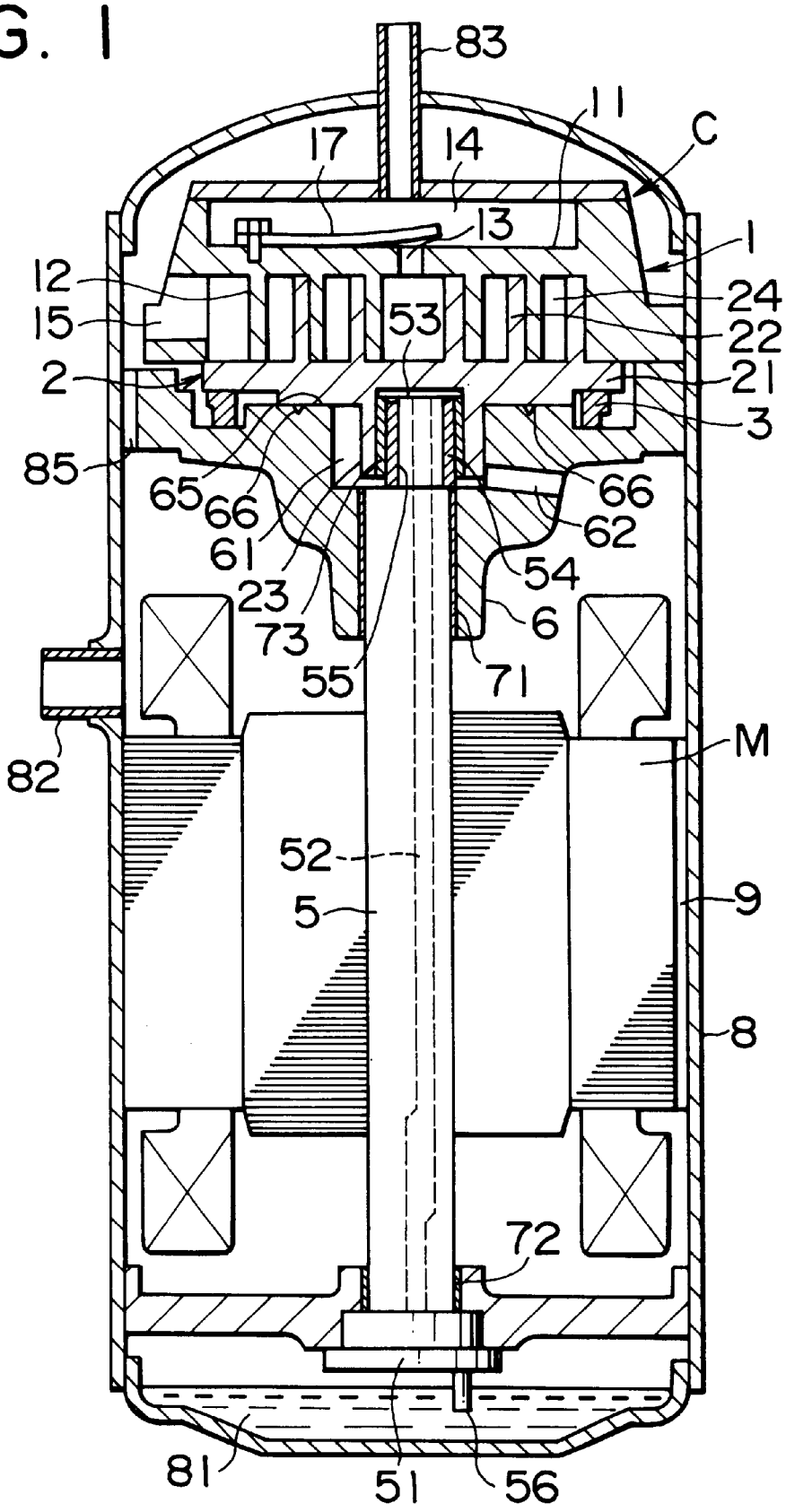
FIG. 1 is a longitudinal sectional view showing an overall configuration of a first embodiment of a scroll-type compressor having a mechanism for preventing seizure of a bearing for an orbiting scroll in accordance with the present invention.

FIG. 1 is a longitudinal sectional view of a vertical scroll-type compressor having a mechanism for preventing seizure in accordance with a first embodiment of the present invention. In a cylindrical closed housing 8, a scroll-type compressing mechanism C is housed at the upper part thereof and an electric motor M at the lower or intermediate part thereof. The compressing mechanism C is connected to the electric motor M via a rotating shaft 5 so as to be driven by the electric motor M. The scroll-type compressing mechanism C includes a fixed scroll 1, an orbiting scroll 2, a rotation checking mechanism such as an Oldham's ring, which permits orbital motion of the orbiting scroll 2 but checks rotation thereof, a frame 6 to which the fixed scroll 1 is fastened, and an upper bearing 71, which pivotally supports the rotating shaft 5, as disclosed in Japanese Patent Provisional Publication No. 7-63174 (No. 63174/1995), for example. An example of the Oldham's ring is disclosed in Japanese Patent Provisional Publication No. 8-35495 (No. 35495/1996), for example.

Figure 7:
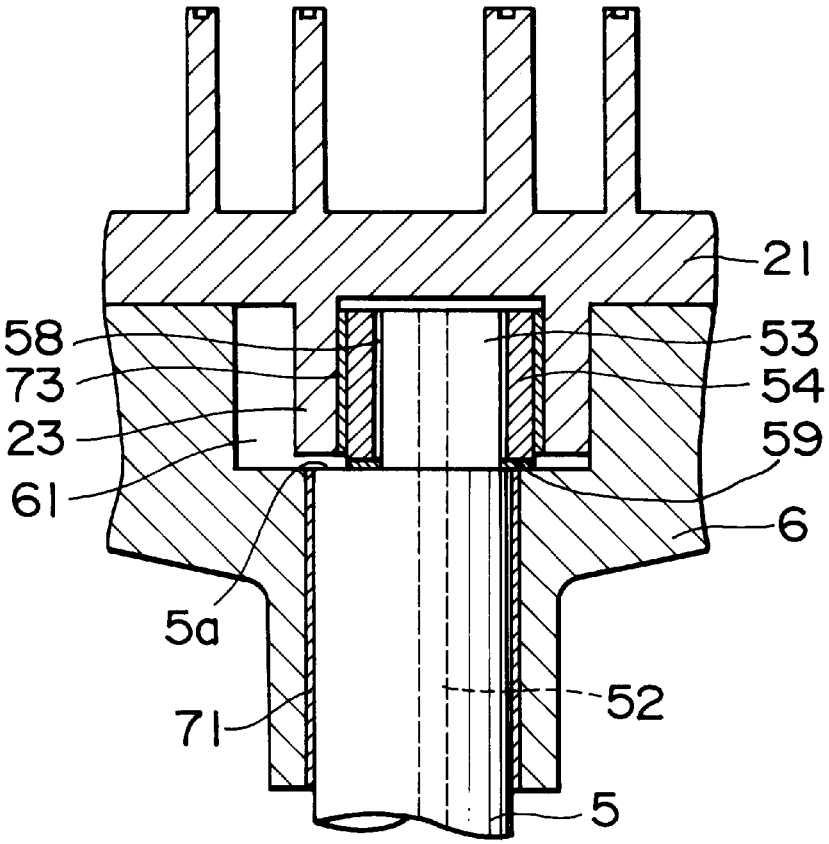
FIG. 7 is a side sectional view corresponding to FIG. 3 showing a scroll-type compressor in accordance with a third embodiment of the present invention.

The fixed scroll 1 has an end plate 11 and a spiral wrap 12 extending downward from the lower surface of the end plate 11. The end plate 11 is provided with a discharge port 13, which is formed by penetrating the end plate 11, and a discharge valve 17 for opening/closing the discharge port 13. The orbiting scroll 2 has an end plate 21 and a spiral wrap 22 extending upward from the upper surface of the end plate 21. The two spiral wraps 12 and 22 are lapped in the radial direction. In a cylindrical boss 23 provided so as to extend downward from the lower surface of the end plate 21, an eccentric bush 54 is rotatably inserted via an orbiting bearing (bearing) 73. Into a hole 55 defined by the eccentric bush 54, an eccentric pin (eccentric pin portion) 53 protruding from the top end of the rotating shaft 5 so as to be off-centered with respect to the axis thereof is rotatably fitted. By engaging the spiral wraps 12 and 22 with each other so that the fixed scroll 1 and the orbiting scroll 2 are made off-centered by a predetermined distance and the angle thereof is shifted 180 degrees, a plurality of closed spaces 24 are formed. The spiral wraps 12 and 22 which form such closed spaces 24 are shown in FIG. 7 of Japanese Patent Provisional Publication No. 7-63174 (No. 63174/1995), for example.

The frame 6 is fixed in the closed housing 8, and the thrust surface 65 formed on the upper surface of the frame 6 is in slidable contact with the lower surface of the orbiting scroll 2 so that the orbiting scroll 2 is supported by the frame 6. The thrust surface 65 is formed with an annular oil groove 66. The top opening of a hole circular in transverse cross section formed at the center of the upper surface of the frame 6 is closed by the lower surface of the orbiting scroll 2, thereby defining an oil reservoir 61. At the lower part of the hole inner wall surface of the frame 6, which defines the oil reservoir 61, is formed a oil discharge hole 62 so as to be inclined downward toward the outside in the radial direction.

A positive-displacement oil pump 51 is installed at the lower end of the rotating shaft 5. A suction pipe 56 is connected to a suction port (not shown) of the oil pump 51, and the tip end thereof is open in an oil sump 81 at the bottom of the closed housing 8. A discharge port (not shown) of the oil pump 51 is connected to an oil supply hole 52 formed in the rotating shaft 5 in the axial direction. This oil supply hole 52 penetrates the rotating shaft 5 and extends upward, and also penetrates the eccentric pin 53 and is open at the tip end of the eccentric pin 53.

By driving the electric motor M, the orbiting scroll 2 is driven via an orbital motion mechanism consisting of the rotating shaft 5, eccentric pin 53, eccentric bush 54, boss 23, etc. The orbiting scroll 2 performs orbital motion in the circular orbit with the orbiting radius while the rotation is checked by the rotation checking mechanism 3.

By this motion, suction gas enters the closed housing 8 through a suction pipe (gas inlet) 82, being introduced into a suction passage 15 in the orbiting scroll 1 through a gas passage 85 formed in the frame 6, and sucked into the aforesaid closed spaces 24. The suction gas reaches the central portion of the spiral wraps 12, 22 while being compressed as the volume of the closed space 24 is decreased as known by the orbital motion of the orbiting scroll 2, goes out through the discharge port 13 formed in the end plate 11, and enters the discharge cavity 14 defined in the scroll-type compressing mechanism C by pushing and opening the discharge valve 17, being discharged to the outside through a discharge pipe (gas outlet) 83 connected to the scroll-type compressing mechanism C so as to communicate with the discharge cavity 14.

On the other hand, since the oil pump 51 is also driven at the same time the electric motor M is driven, lubricating oil stored in the oil sump 81 at the bottom of the closed housing 8 is sucked via the suction pipe 56, being sent to the oil supply hole 52. The lubricating oil flows upward in the oil supply hole 52. Some of the lubricating oil branches halfway from the main flow to lubricate a lower bearing 72 and the upper bearing 71, and the main flow sprouts from an opening of the oil supply hole 52 formed at the tip end of the eccentric pin 53 to lubricate the eccentric pin 53 and the orbiting bearing 73, and enters the oil reservoir 61. Subsequently, the lubricating oil passes through the oil groove 66 to lubricate sliding parts such as the thrust surface 65 and the rotation checking mechanism 3. Also, some of the lubricating oil entering the oil reservoir 61 drops through the oil discharge hole 62, passes through a passage 9 formed between the outer periphery of the stator of the electric motor M and the closed housing 8, and is finally returned to the oil sump 81 and stored therein.

Figure 2:
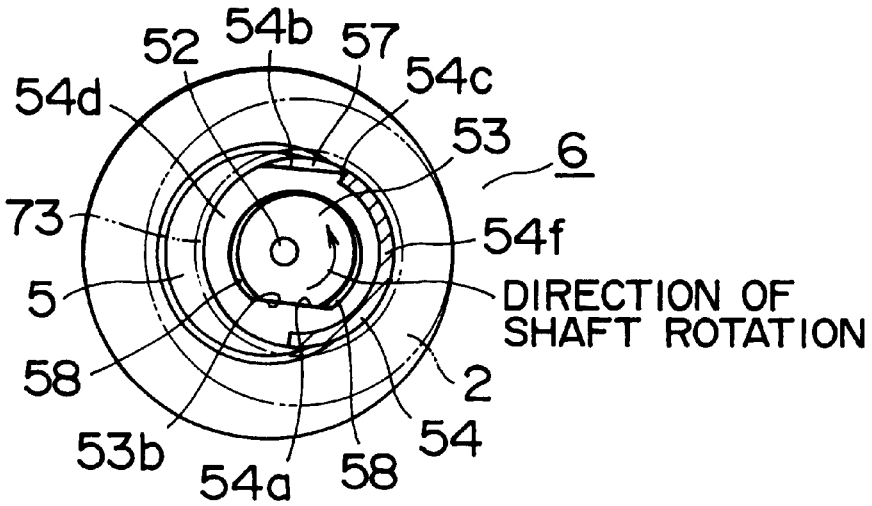
FIG. 2 is a plan view, partly in cross section, of an eccentric bush, eccentric pin, etc. relating to the aforesaid mechanism for preventing seizure shown in FIG. 1, being viewed from the upside.
Figure 3:
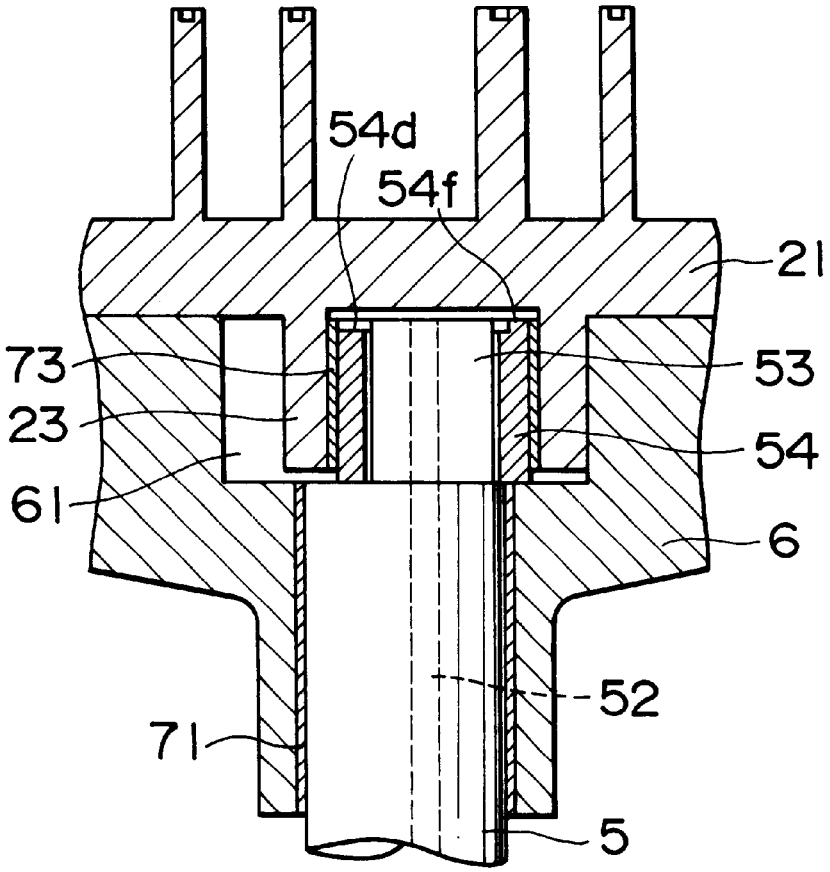
FIG. 3 is an enlarged side sectional view showing the aforesaid mechanism for preventing seizure.

FIG. 2 is a view for illustrating the relationship between the eccentric bush 54 and eccentric pin 53 in the above-described scroll-type compressor of the present invention, being viewed from the upside, and FIG. 3 is a sectional view for illustrating the relationship, viewed from the side. These figures correspond to FIGS. 9 and 10 showing the related art, respectively. A part of the peripheral surface of the eccentric bush 54, which defines the inner peripheral surface or the hole 55, is formed as a flat portion 54*a*, and the flat portion 54*a* abuts on a flat portion 53*b* formed at a part of the outer peripheral surface of the eccentric pin 53, so that the eccentric bush 54 rotates integrally with the eccentric pin 53. At the outer peripheral portion of the eccentric bush 54 opposing to the flat portion 54*a* substantially in the radial direction about 180° apart in the circumferential direction, a flat portion 54*b* is formed. This flat portion 54*b* defines an oil supply path (oil supply hole) 57 extending in the axial direction in cooperation with the orbiting bearing 73. The upper end of the oil supply path 57 is open at the upper end face of the eccentric bush 54 and the lower end thereof is open to the oil reservoir 61.

As seen from the comparison of FIG. 2 and FIG. 9, the upper end face of the eccentric bush 54 is cut or removed to form a flat portion as indicated by 54*d* over the total wall thickness in the radial direction of the eccentric bush 54 from one end 54*c* of the flat portion 54*b* on the upstream side with respect to the direction of rotation of the rotating shaft 5 indicated by the arrow to a portion corresponding to the substantially intermediate position in the circumferential direction of the flat portion 54*a* (left side portion in FIG. 2), in other words, over an angular range of about 180° in the circumferential direction. The cut region is expanded as compared with FIG. 9. Therefore, the lubricating oil discharged from the oil supply hole 52 at the upper end face of the eccentric bush 54 is pushed toward the outer periphery of the eccentric bush 54 by a centrifugal force at the flat portion 54*d*, and is supplied efficiently to the oil supply path 57 by being blocked by the orbiting bearing 73. Thereby, the amount of oil supplied to the oil supply path 57 is increased significantly. The upper end face of the eccentric bush 54 is not cut in nearly the same manner as in FIG. 9 from one end 54*c* of the flat portion 54*b* on the upstream side with respect to the direction of rotation of the rotating shaft 5 indicated by the arrow to a portion corresponding to the substantially intermediate position in the circumferential direction of the opposing flat portion 54*a* (right side portion in FIG. 2), and an arcuate protrusion 54*f* exists on the outer periphery side. The upper end face of this protrusion 54*f* is flush with the upper end face of the eccentric pin 53, but it may be positioned slightly above or below the upper end face of the eccentric pin 53.

[Second Embodiment]

Figure 4:
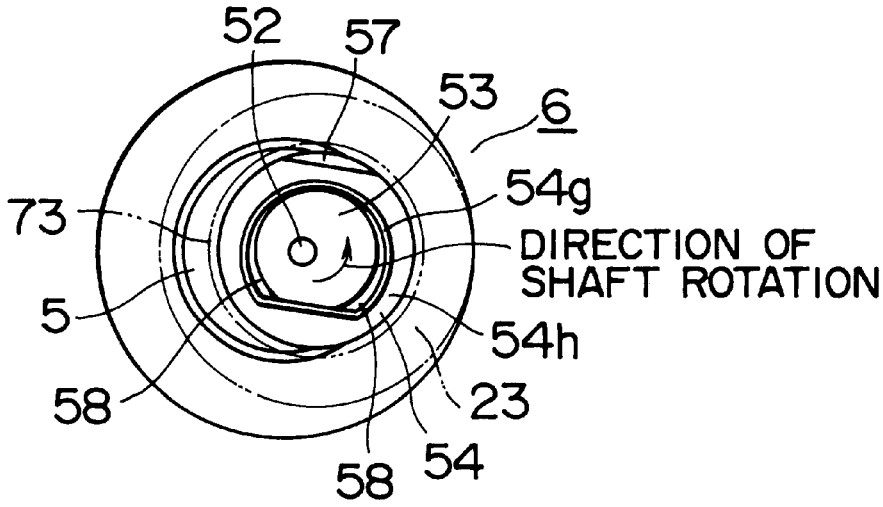
FIG. 4 is a plan view corresponding to FIG. 2 showing a scroll-type compressor in accordance with a second embodiment of the present invention.
Figure 5:
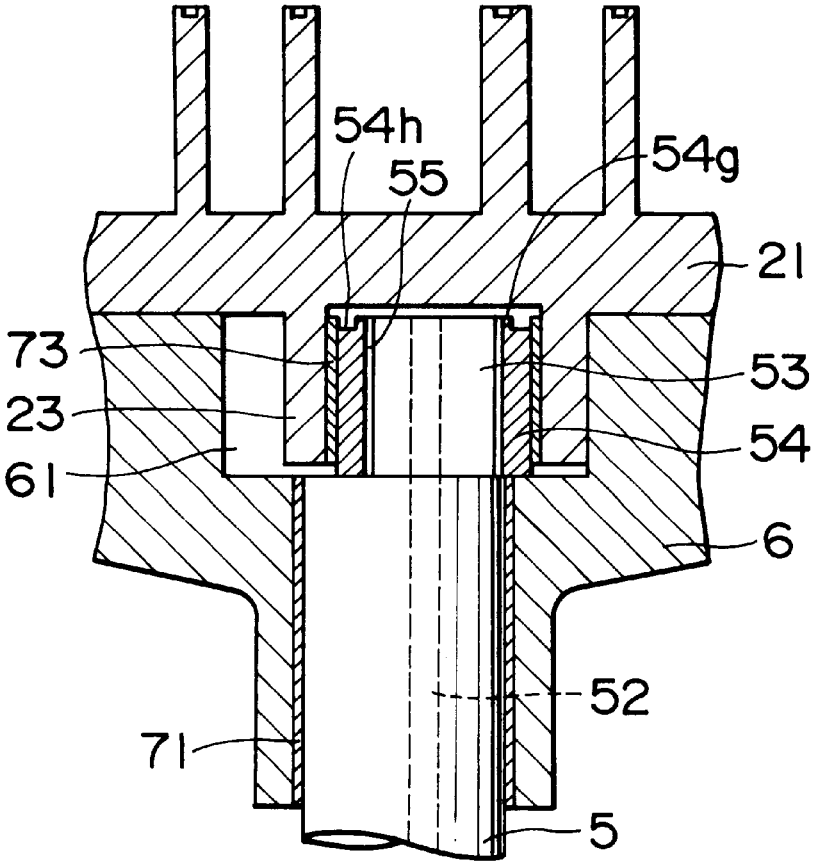
FIG. 5 is a side sectional view corresponding to FIG. 3 showing a scroll-type compressor in accordance with a second embodiment of the present invention.

In a second embodiment of the present invention shown in FIGS. 4 and 5, only a configuration different from that of the first embodiment will be described. As seen best from FIG. 5, an annular protrusion 54*g* is provided on the upper end face of the eccentric bush 54 along the whole upper edge of the inner periphery of the hole 55. The other portion on the upper end face is cut to form a flat portion (outer peripheral portion) 54*h* lower than the protrusion 54*g* (this flat portion defines an annular concave in consequence in cooperation with the surrounding orbiting bearing 73). The upper end face of this protrusion 54*g* is flush with the upper end face of the eccentric pin 53. By forming this protrusion 54*g*, at least some of the lubricating oil flowing out of the oil supply hole 52 at the upper end face of the eccentric bush 54 enters, not the gap 58, but a concave defined by the flat portion 54*h* and the orbiting bearing 73, and is guided effectively from here to the oil supply path 57. The flow of lubricating oil from the oil supply hole 52 to the concave defined by the flat portion 54*h* and the orbiting bearing 73 is caused, at least partly, by centrifugal force resulting from rotation of the shaft 5. Thereby, the amount of oil supplied to the oil supply path 57 is increased significantly.

[Third Embodiment]

Figure 6:
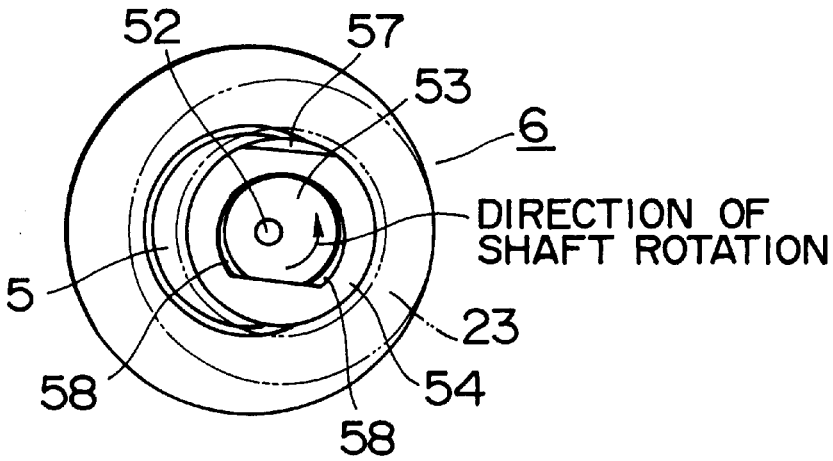
FIG. 6 is a plan view corresponding to FIG. 2 showing a scroll-type compressor in accordance with a third embodiment of the present invention.

In a third embodiment of the present invention shown in FIGS. 6 and 7, only a configuration different from that of the first embodiment will be described. The whole of the upper end face of the eccentric bush 54 is made flat, so that the lubricating oil is allowed to flow into the gap 58. However, in order to prevent the lubricating oil flowing into the gap 58 from dropping into the oil reservoir 61, an annular flat plate (flat plate member) 59 with a suitable thickness and size is interposed between the lower end face of the eccentric bush 54 and the upper end shoulder 5*a* of the rotating shaft 5 so as to substantially cover the lower end of the gap 58. Thereby, of the lubricating oil flowing out of the oil supply hole 52 at the upper end face of the eccentric bush 54, part thereof flowing into the gap 58 is stored in the gap 58 without dropping into the oil reservoir 61. When the volume of the gap 58 is decreased by the motion of the eccentric pin 53, the lubricating oil is discharged upward from the gap 58, and supplied to the oil supply path 57 together with the lubricating oil released from the oil supply hole 52 to the upper end face of the eccentric bush 54. Thereupon, the discharge amount to the oil supply path 57 is increased significantly. In this embodiment, the upper end face of the eccentric bush 54 is flush with the upper end face of the eccentric pin 53, but this is not always necessary. It may be terminated at a position below or above the upper end face of the eccentric pin 53.

The preferred embodiments of the present invention have been described above. However, the present invention is not limited to these embodiments, and various modifications can be made. For example, (1) The present invention is characterized by the prevention of seizure of orbiting bearing. Therefore, the members less relevant to the construction for this purpose are not restricted by the construction used in the embodiments, (2) In the embodiments, the flat portion of the eccentric bush 54 and the flat portion of the eccentric pin 53, which abut on each other, lie at a position opposing to the oil supply path 57 in the radial direction about 180° apart in the circumferential direction. However, the flat portion may be formed at an angular position smaller or larger than 180° from the oil supply path 57, (3) In this case, in the first embodiment, the arcuate protrusion 54*f* on the outer peripheral edge side of the upper end face of the eccentric bush 54 extends from one end 54*c* of the flat portion 54*b* of the eccentric bush 54 to the portion corresponding to the substantially intermediate position in the circumferential direction of the flat portion 54*a*. However, the position at which the protrusion 54*f* terminates may be in the angular range of about 180°, not the portion almost corresponding to the intermediate position, and (4) In the third embodiment, the upper end face of the eccentric bush 54 is flush with the upper end face of the eccentric pin 53, but this is not always necessary. It may be at a position below or above the upper end face of the eccentric pin 53. Also, as in the first and second embodiments, the upper end face of the eccentric bush 54 may be formed with a protrusion 54*f*, 54*g* or a flat portion 54*d*, 54*h*.

What is claimed is:

1. A scroll-type compressor comprising a closed housing having a gas inlet and outlet; a support frame fixed in said closed housing; a scroll-type compressing mechanism which has a fixed scroll and an orbiting scroll disposed above said support frame and engaging with each other, wherein said fixed scroll is fastened to said support frame, and said orbiting scroll is supported by and in slidable contact with said support frame; a rotating shaft which is disposed below said scroll-type compressing mechanism, extends upward by penetrating said support frame and is fitted in a boss of said orbiting scroll at an eccentric pin portion at the upper end via an eccentric bush and a bearing; a motor for driving said orbiting scroll via said rotating shaft; and an oil pump provided at the lower end of said rotating shaft, said rotating shaft and said eccentric pin portion being formed with an oil supply hole, which communicates with said oil pump and is open at an upper end face of said eccentric pin portion, so that lubricating oil is provided through said oil supply hole in response to said oil pump being driven and at least some of the lubricating oil flowing out of said oil supply hole is supplied to said bearing, wherein a gap is formed between an outer peripheral surface of said eccentric pin portion and an inner peripheral surface of said eccentric bush, and said scroll-type compressor further comprises an annular flat plate member positioned between a lower end face of said eccentric bush and an upper end face of said rotating shaft so as to substantially cover a lower end of said gap.

2. A scroll-type compressor according to claim 1, wherein said gap is operative to permit the orbiting motion of said orbiting scroll.

3. A scroll-type compressor according to claim 2, wherein an oil supply path extends in the axial direction and is provided between an outer peripheral surface of said eccentric bush and an inner peripheral surface of said bearing, so that the lubricating oil flowing out of said oil supply hole is supplied to said bearing via said oil supply path and supplied to a space between said support frame and said orbiting scroll.

4. A scroll-type compressor comprising:

a closed housing having a gas inlet and outlet;

a support frame fixed in said closed housing;

a scroll-type compressing mechanism which has a fixed scroll and an orbiting scroll disposed above said support frame and engaging with each other, wherein said fixed scroll is fastened to said support frame, said orbiting scroll is supported by and in slidable contact with said support frame, and said orbiting scroll comprises a boss;

a rotating shaft which is disposed below said scroll-type compressing mechanism and extends upward by penetrating said support frame, said rotating shaft having an upper end face and comprising an eccentric pin portion that extends upward from said upper end face;

an eccentric bush mounted to said pin portion, wherein said eccentric bush includes a lower end face;

a bearing that is carried by said boss and is in receipt of said eccentric bush, wherein an outer peripheral oil supply path is defined at least between a portion of said bush and a portion of said bearing, and said outer peripheral oil supply path supplies lubricating oil to said bearing;

a motor for driving said orbiting scroll via said rotating shaft;

an oil pump provided at the lower end of said rotating shaft, wherein said rotating shaft and said eccentric pin portion define an oil supply hole, which communicates with said oil pump and is open at an upper end face of said eccentric pin portion, so that lubricating oil is provided through said oil supply hole in response to said oil pump being driven;

a reservoir that is at least partially defined between an outer peripheral surface of said eccentric pin portion and an inner peripheral surface of said eccentric bush; and a plate that is a discrete component from said rotating shaft and said pin portion, wherein said plate is positioned between said lower end face of said eccentric bush and said upper end face of said rotating shaft so that said plate substantially occludes a lower end of said reservoir in a manner such that said reservoir is operative for receiving and storing oil from said oil supply hole, and so that the rotation of the rotating shaft and the resulting motion of the eccentric pin decreases the size of the reservoir so that oil stored by the reservoir is discharged upwardly out of said reservoir and substantially soon thereafter flows downwardly into the outer peripheral oil supply path.

5. A scroll-type compressor according to claim 4, wherein said plate includes:

an upper surface that is engaged to said lower end face of said eccentric bush, and a lower surface that is opposite from said upper surface and engaged to said upper end face of said rotating shaft.

6. A scroll-type compressor according to claim 4, wherein said plate extends at least partially around said rotating shaft.

7. A scroll-type compressor according to claim 6, wherein said plate extends at least partially around said eccentric pin portion of said rotating shaft.

8. A scroll-type compressor according to claim 4, wherein said plate is annular and defines a central opening, and said eccentric pin portion of said rotating shaft extends through said opening of said plate.

9. A scroll-type compressor according to claim 8, wherein said plate includes:

an upper surface that is engaged to said lower end face of said eccentric bush, and a lower surface that is opposite from said upper surface and engaged to said upper end face of said rotating shaft.

10. A scroll-type compressor according to claim 4, wherein said portion of said bearing, which at least partially defines said outer peripheral oil supply path, is flat and upright.

11. A scroll-type compressor according to claim 10, wherein said plate includes:

an upper surface that is engaged to said lower end face of said eccentric bush, and a lower surface that is opposite from said upper surface and engaged to said upper end face of said rotating shaft.

12. A scroll-type compressor according to claim 10, wherein said plate extends at least partially around said rotating shaft.

13. A scroll-type compressor according to claim 12, wherein said plate extends at least partially around said eccentric pin portion of said rotating shaft.

14. A scroll-type compressor according to claim 10, wherein said plate is annular and defines a central opening, and said eccentric pin portion of said rotating shaft extends through said opening of said plate.

15. A scroll-type compressor according to claim 14, wherein said plate includes:

an upper surface that is engaged to said lower end face of said eccentric bush, and a lower surface that is opposite from said upper surface and engaged to said upper end face of said rotating shaft.

* * * * *

UNITED STATES PATENT AND TRADEMARK OFFICE

CERTIFICATE OF CORRECTION

PATENT NO. : 6,361,296 B1
DATED : March 26, 2002
INVENTOR(S) : Hirooka et al.

It is certified that error appears in the above-identified patent and that said Letters Patent is hereby corrected as shown below:

Title page, Item [54] and Column 1, line 3,
In the title, "OR" should read -- FOR --.

Signed and Sealed this

Eleventh Day of June, 2002

*Attest:*

*Attesting Officer*

JAMES E. ROGAN
*Director of the United States Patent and Trademark Office*